United States Patent [19]

Roberts et al.

[11] 3,946,236

[45] Mar. 23, 1976

[54] ENERGETIC ELECTRON BEAM ASSISTED X-RAY GENERATOR

[75] Inventors: Thomas G. Roberts; Romas A. Shatas; Harry C. Meyer, III; John D. Stettler, all of Huntsville, Ala.

[73] Assignee: The United States of America as represented by the Secretary of the Army, Washington, D.C.

[22] Filed: Apr. 4, 1974

[21] Appl. No.: 457,865

[52] U.S. Cl. ..... 250/402; 250/493

[51] Int. Cl.[2] ..... G21G 4/00

[58] Field of Search ..... 250/492, 493, 499, 500, 250/501, 502, 402; 313/55, 330

[56] References Cited

UNITED STATES PATENTS

| | | | |
|---|---|---|---|
| 3,526,575 | 9/1970 | Bennett | 250/500 |
| 3,746,860 | 7/1973 | Shatas | 250/493 |
| 3,748,475 | 7/1973 | Shatas | 250/502 |
| 3,766,004 | 10/1973 | Roberts | 250/502 |
| 3,864,640 | 2/1975 | Bennett | 250/500 |

*Primary Examiner*—Craig E. Church

*Attorney, Agent, or Firm*—Nathan Edelberg; Robert P. Gibson; James T. Deaton

[57] ABSTRACT

Energetic electron beam assisted x-ray generator in which a plasma is produced by a plasma generator and seeded by high Z material to produce x-rays and to increase the number of x-rays, an electron beam source is guided to the produced plasma to further heat the plasma and produce an even greater number of x-rays. The inner electrode of the plasma generator utilizes the interaction of the beam's self magnetic field with the inner surface of the inner electrode to guide the electron source to the plasma.

9 Claims, 1 Drawing Figure

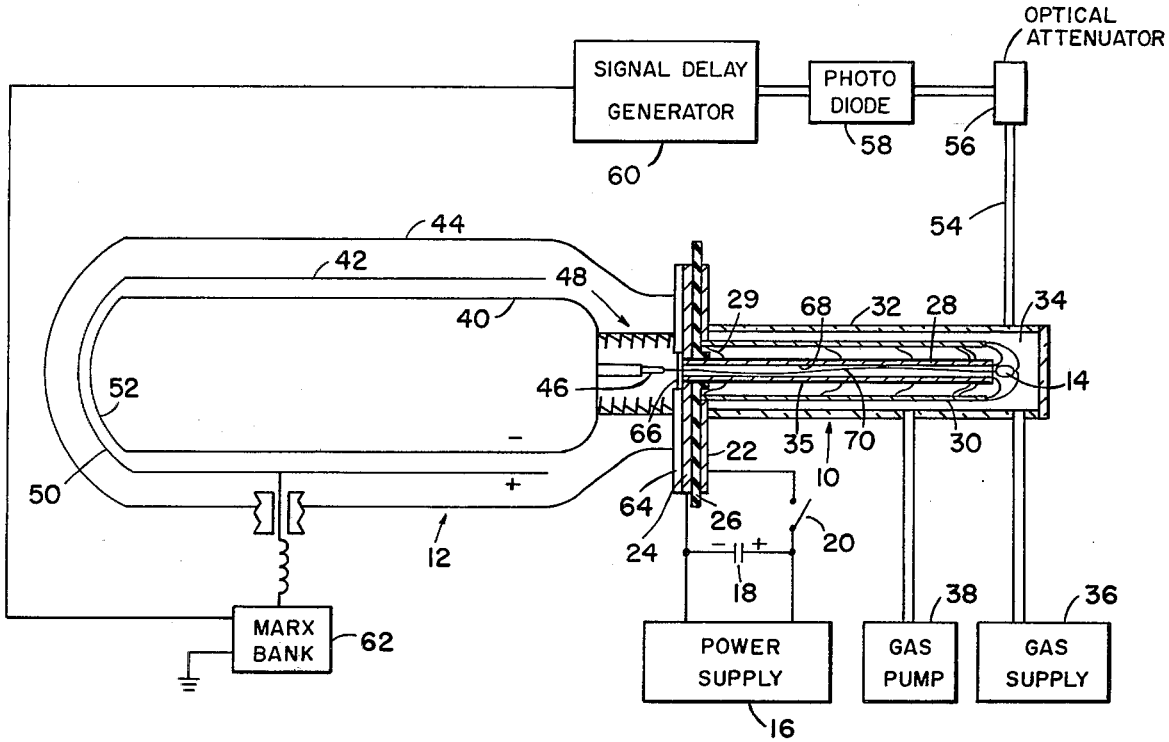
OPTICAL ATTENUATOR
SIGNAL DELAY GENERATOR
PHOTO DIODE
60
58
56
54
44
42
48
40
29
68
32
28
34
52
46
14
66
35
70
30
22
10
50
64
26
20
24
12
18
MARX BANK
62
POWER SUPPLY
16
GAS PUMP
38
GAS SUPPLY
36

ENERGETIC ELECTRON BEAM ASSISTED X-RAY GENERATOR

BACKGROUND OF THE INVENTION

Soft x-ray pulses of submicrosecond duration are needed to test materials and components of pulsed fusion reactions. Techniques presently employed to generate such pulses are (a) electron diode guns bombarding a heavy metal target, (b) underground fusion devices and (c) dense focus with high Z material electrode tips which erode during the pulse. Electron diode guns at the required x-ray energies of fractional MeV are very inefficient because the conversion efficiency of electron beam energy into Bremsstrahlung decreases superlinearly with the decrease of electron energy for a given target anode, a fact which is well known to the designers of flash x-ray tubes. In addition, at low electron energies of fractional MeV, the space charge of electron beam is not cancelled by relativistic effects and limits severely the maximum current density of the electron beam available at the target anode. Furthermore, the electric fields at the cathode are usually not sufficient to obtain a copious electron emission by the field effect and therefore the thermionic cathodes must be employed which intrinsically yield a much lower electron emission current density than field emitters. Present electron beam-Bremsstrahlung flash generators of minimum useful x-ray fluence therefore employ electron beams in the several MeV range. They generate x-ray flashes of spectral distribution which contains most of the photon energy in the hard x-ray spectral range. Because the x-ray penetration depth decreases superlinearly with the photon energy, the deposited x-ray energy density in test materials and components is substantially different for soft and hard x-ray flashes of identical fluence at the source. Therefore, pass-fail conclusions of tests on materials, components and devices performed with many MeV energy electron beam x-ray flash generators are not directly scalable to predict the performance under a soft x-ray flash. Underground fusion flash tests suffer from the intrinsic inability to separate by the time-of-flight method the various components of radiations and expansion waves generated during the test. Therefore, various radiation and blast wave effects cannot be readily differentiated and only the cumulative, gross effects are observed. Thus, the materials designer is handicapped in separating the individual contributions from each damaging radiation.

The plasma focus alone can also be used as a soft x-ray flash generator by altering the electrode design and configuration such as to increase the evaporation and erosion of certain portions of the electrodes. Because only the energy stored in the plasma focus can be used for soft x-ray production, the fluence of x-ray flash is limited. In addition, a full control of erosion of the electrodes cannot be achieved in this case. Therefore, the intensity and the spectral distribution of x-ray flashes varies from one firing to another.

Therefore, it is an object of this invention to overcome deficiencies and eliminate or substantially reduce problems encountered in producing soft x-rays.

Another object of this invention is to provide a x-ray generator in which the energies from an electron source and a plasma generator are combined to produce soft x-rays when the plasma has been seeded with high Z material.

Still another object of this invention is to provide a x-ray generator in which electrons from an electron beam source are guided and focused onto a hot seeded plasma produced by a plasma generator.

SUMMARY OF THE INVENTION

A x-ray generator in which an internal source of high energy electrons, such as from a modern flash x-ray machine operated in the electron beam mode, and a plasma generator, such as a coaxial plasma gun, are arranged and operated so that the high energy electron beam is focused onto and retained near a seeded volume where the high density plasma is produced by having the electron beam source guided to the high density plasma by the inner electrode of the plasma generator. The timing of the transmission of the high energy electron beam to the plasma is accomplished by use of photocontrol means to determine when the plasma has reached the desired volume and when the high energy electron beam will reach the desired volume. Soft x-rays are produced by seeding the high density plasma with a high Z material and the soft x-rays are increased in number by interaction of the electron beam with the high density plasma. Thus, this x-ray generator is used to increase the production of soft x-rays from free-free transitions (Bremsstrahlung), free-bound transitions (recombination) or bound-bound transitions (line radiation), when the plasma has been seeded with a small amount of high Z (atomic number) material. The high Z atoms cause the plasma to radiate its energy away in the form of soft x-rays produced in free-free transitions, free-bound transitions, and bound-bound transitions primarily between the electrons and the high Z ions.

BRIEF DESCRIPTION OF THE DRAWING

In the drawing:

The single FIGURE is a diagrammatic view partially in section of a x-ray generator according to this invention.

DESCRIPTION OF THE PREFERRED EMBODIMENT

Referring now to the drawing, the apparatus according to this invention includes a plasma generator 10 and an electron beam source 12. Plasma generator 10 and electron beam source 12 are axially aligned for concentrating their energies in a plasma volume 14 such as illustrated. Power supply 16 is provided for plasma generator 10 and the electrical system thereof includes a condenser bank 18 and starting switch 20 that are connected to inner conductor 22 and outer conductor 24. Inner and outer conductors 22 and 24 are separated by an insulator 26 and outer conductor 24 is connected to the negative side of capacitor bank 18 while inner conductor 22 is connected to the positive side. Outer conductor 24 is electrically connected to inner electrode 28 of the plasma gun portion of plasma generator 10 and inner conductor 22 is connected to outer electrode 30 of the plasma gun. An outer housing 32 generally made of glass encloses the plasma gun to form a chamber 34 therein. A gas pump 38 is connected into housing 32 for evacuating chamber 34 and gas supply 36 is connected to housing 32 for supplying gases to chamber 34. The gas in chamber 34 is hydrogen or hydrogen with about a 5% molar mixture of uranium hexafluoride or other gas with high Z material. If hydrogen gas alone is used in chamber 34, inner electrode 28 has a heavy metal high Z material coating 35 on the outer surface of inner electrode 28. The heavy metal high Z material is selected from metals such as copper, tungsten, titanium, zirconium and etc.

Electron source 12 consists of an internal source of high energy electrons such as a modern flash x-ray machine operated in the electron beam mode, and as illustrated includes three coaxial cylinders 40, 42, and 44. Inner cylinder 40 is connected to high voltage terminal 46 of discharge tube 48. Rounded end 50 of intermediate cylinder 42 is close to rounded end 52 of inner cylinder 40. Outer cylinder 44 forms the wall of the cylindrical tank of the electron source which is filled with oil or an insulating gas everywhere except in the discharge tube. It is to be understood that other electron producing sources than that illustrated can be used in this invention.

Control means for electron energy source 12 includes operationally connected light pipe 54, optical attenuator 56, photo-diode 58, signal delay generator 60, and Marx bank 62 that is conventionally connected to electron energy source 12 as illustrated. Marx bank 62 as illustrated contains its own power supply and the Marx bank is normally charged being in condition for discharge upon the appropriate signal from signal delay generator 60. Plasma generator 10 and electron beam source 12 are interconnected structurally through plate 64 which contains window 66. Plate 64 and window 66 seal plasma generator 10 and electron beam source 12 fluidly relative to each other and closes chamber 34 of plasma generator 10. Window 66 is made of conventional material that will pass electrons therethrough.

In operation, the device is prepared by first having chamber 34 of plasma generator 10 filled with the appropriate gas to be used. As illustrated, power supply 16 has charged its condenser bank 18 and Marx bank 62 has been charged and made ready for firing. The device is now ready for operation by closing switch 20. The closing of switch 20 causes the voltage of condenser bank 18 to appear across the electrodes of the coaxial dense plasma focus gun and the gases in the coaxial plasma generator break down near insulator 26 forming current sheath 29. Current sheath 29 then propagates between the outer electrode 30 and inner electrode 28 and is driven by the magnetic pressure of its own magnetic field. The discharge becomes more intense as the sheath propagates. When current sheath 29 reaches the end of electrodes 28 and 30, it folds back on itself and rapidly collapses the plasma toward the axis of plasma generator 10 as in a Z-pinch. This produces hot plasma volume 14 where electron or ion number density may be as high as $10^{19}$ $cm^{-3}$, the temperature may be as high as several times $10^{7°}$ Kelvin and the confining magnetic fields of the order of megagauss. At this time and for a period of the order of a microsecond, x-rays are produced.

The velocity of the propagation of current sheath 29 and therefore the time of collapse of the plasma toward the axis is a function of the voltage on condenser bank 18. As current sheath 29 is propagating between electrodes 28, 30 light is produced that increases in intensity and the light is detected by light pipe 54 which carries the detected light to photo-diode 58 after having passed through optical attenuator 56. Optical attenuator 56 is preset so that accidential changes in the light intensity will not cause signal delay generator 60 to begin to operate until current sheath 29 has reached a predetermined location along the plasma generator.

Light pipe 54 and photo-diode 58 are used partially to insure the noise does not start signal delay generator 60 to function too soon. The signal which starts signal delay generator 60 is delayed a preset amount and is then used to erect Marx bank 62 of electron source 12 to cause high energy electrons to enter bore 68 of inner electrode 28 through thin window 66 from electron 46. Once the high energy electrons find themselves in the space of bore 68, their space charge is neutralized and they are guided by the interaction of their own magnetic field with the inner surface of electrode 28. Consequently, they form a beam 70 which is guided by the interaction of its magnetic field with electrode 28 to dense plasma 14. The interaction of the magnetic fields with electrode 28 does not cause the electron beam 70 to maintain a path in a generally straight line, but the magnetic fields guide the beam such that the beam does not touch the inner surface of bore 68.

As can be seen, the high magnetic fields of the plasma focus device about the end of electrode 28 are arranged so that the high energy electrons from electrode 46 are focused onto the plasma volume which contains the high temperature, high density plasma. The energy delivered to the plasma will tend to raise the temperature of the plasma, but instead nearly all of the added energy from the electron source will be radiated away in the form of x-rays. If high Z material 35 is not present in the device, plasma 14 is seeded with the high Z material in the gas filling chamber 34. If high Z material 35 is used, the high Z material is radiated into the hydrogen atmosphere in chamber 34 as current sheath 29 moves down electrodes 28, 30 to cause plasma 14 to be seeded. As can be seen, the magnetic field configuration of this invention is such that electron beam 70 is transmitted by inner electrode 28 to the hot plasma that is seeded with high Z material to cause greater numbers of x-rays to be produced.

In order to operate the x-ray generator again, one must recharge condenser bank 18 and Marx bank 62. It may also be necessary from time to time to replace window 66.

We claim:

1. An electron beam assisted x-ray generator comprising a plasma generator for producing a plasma, a source of high energy electrons, said plasma generator and said source of high energy electrons being mounted coaxially for transmission of electrons from said source of high energy electrons and propagation of said electrons through a bore within an inner electrode of said plasma generator, high Z material in said plasma generator for seeding said plasma, and control means for said plasma generator and said source of high energy electrons for causing x-rays to be produced from direct interaction and bombardment of the plasma produced by the plasma generator and said electrons from said source of high energy electrons when said plasma has been seeded with said high Z material, said control means being such as to cause said electrons to have their space charge neutralized when they enter said bore and to be guided by interaction of their magnetic field with an inner surface of said bore to deliver said electrons to said plasma.

2. An electron beam assisted x-ray generator as set forth in claim 1, wherein said control means for the plasma generator and the source of high energy electrons includes control circuitry for the plasma generator including a power supply connected to a capacitor bank and means connecting the capacitor bank through a control switch to electrodes of the plasma generator including said inner electrode.

3. An electron beam assisted x-ray generator as set forth in claim 2, wherein said inner electrode is connected to the negative side of said capacitor bank.

4. An electron beam assisted x-ray generator as set forth in claim 2, wherein said control means for said source of high energy electrons includes means responsive to a predetermined light condition established in the plasma generator upon firing of the plasma generator to cause said source of high energy electrons to be emitted.

5. An electron beam assisted x-ray generator as set forth in claim 4, wherein said plasma generator has a chamber that is filled with a gas, and said gas contains said high Z material.

6. An electron beam assisted x-ray generator as set forth in claim 5, wherein said gas is a mixture of hydrogen and 5 percent molar fraction of uranium hexafluoride.

7. An electron beam assisted x-ray generator as set forth in claim 4, wherein said plasma generator and said source of high energy electrons are joined through a plate that has a window therein that allows electrons from said electron source to pass therethrough and into said bore of said inner electrode.

8. An electron beam assisted x-ray generator as set forth in claim 4, wherein said high Z material is selected from the group consisting of copper, tungsten, titanium, and zirconium.

9. An electron beam assisted x-ray generator as set forth in claim 8, wherein said high Z material is on the outer surface of said inner electrode.

* * * * *